US006637481B2

(12) United States Patent
Mak et al.

(10) Patent No.: US 6,637,481 B2
(45) Date of Patent: Oct. 28, 2003

(54) APPARATUS FOR SHARPENING A WRITING INSTRUMENT

(76) Inventors: King Biu Mak, Rm. A12, 5/F., Block A2, Yau Tong Industrial City, 17 Ko Fai Road, Yau Tong, Kowloon (HK); Chung Yin Ronald Mak, Rm. A12, 5/F., Block A2, Yau Tong Industrial City, 17 Ko Fai Road, Yau Tong, Kowloon (HK); Chung Ming Mak, Rm. A12, 5/F., Block 2, Yau Tong Industrial City, 17 Ko Fai Road, Yau Tong, Kowloon (HK)

( * ) Notice: Subject to any disclaimer, the term of this patent is extended or adjusted under 35 U.S.C. 154(b) by 22 days.

(21) Appl. No.: 10/096,244

(22) Filed: Mar. 13, 2002

(65) Prior Publication Data

US 2003/0172992 A1 Sep. 18, 2003

(51) Int. Cl.[7] ..... B43L 23/02

(52) U.S. Cl. ..... 144/28.5; 144/28.72; 144/28.8; 144/28.9

(58) Field of Search ..... 144/28.1, 28.3, 144/28.5, 28.6, 28.72, 363, 28.11, 28.2, 28.4, 28.7, 28.8, 28.9; 30/451, 452, 453, 454, 457

(56) References Cited

U.S. PATENT DOCUMENTS

| | | | | | |
|---|---|---|---|---|---|
| 2,123,511 | A | * | 7/1938 | Lobel et al. | 144/28.71 |
| 2,242,458 | A | * | 5/1941 | Dessonnaz | 144/28.1 |
| 6,286,218 | B1 | * | 9/2001 | Luttgens | 30/454 |
| 6,338,198 | B1 | * | 1/2002 | Rolls | 30/452 |

* cited by examiner

*Primary Examiner*—William Hong
*Assistant Examiner*—Shelley Self
(74) *Attorney, Agent, or Firm*—Burns, Doane, Swecker & Mathis, L.L.P.

(57) ABSTRACT

An apparatus for sharpening a writing instrument, e.g. an electric pencil sharpener, is disclosed as including a body for receiving a pencil for sharpening, and a base, the base having a bottom surface to support the apparatus on a surface, and the body may be positioned relative to the base in a first configuration and at least a second configuration, and when the body is positioned relative to the base in the first configuration, a longitudinal axis of the body and an axis perpendicular to the bottom surface of the base subtend a first angle, and when the body is positioned relative to the base in the second configuration, these two axes subtend a second angle which differs from the first angle.

15 Claims, 12 Drawing Sheets

APPARATUS FOR SHARPENING A WRITING INSTRUMENT

This invention relates to an apparatus for sharpening a writing instrument, e.g. pencils, in particular, such an apparatus which may be driven by electricity.

BACKGROUND OF THE INVENTION

Electrically operable pencil sharpeners have been made available for a long time. In most such electric pencil sharpeners, a motor is provided for driving a cutting element, e.g. a helical cutter or a razor cutter, to sharpen the end of a pencil inserted into a hole of the sharpener. In order to insert the pencil into the hole of the sharpener, the pencil has to be positioned in a vertical orientation. This is not comfortable to use.

It is thus an object of the present invention to provide an apparatus for sharpening a writing instrument in which the aforesaid shortcoming is mitigated, or at least to provide a useful alternative to the trade and general public.

SUMMARY OF THE INVENTION

According to the present invention, there is provided an apparatus for sharpening a writing instrument, including a body member and a base member, said body member being adapted to receive said writing instrument for sharpening, said base member having a bottom surface adapted to support said apparatus on a surface, wherein said body member is positionable relative to said base member in a first configuration and at least a second configuration, wherein when said body member is positioned relative to said base member in said first configuration, a longitudinal axis of said body member and an axis substantially perpendicular to said bottom surface of said base member subtend a first angle, and when said body member is positioned relative to said base member in said second configuration, said longitudinal axis of said body member and said axis substantially perpendicular to said bottom surface of said base member subtend a second angle which differs from said first angle.

BRIEF DESCRIPTION OF THE DRAWINGS

Preferred embodiments of the present invention will now be described, by way of examples only, with reference to the accompanying drawings, in which.

DETAILED DESCRIPTION OF THE PREFERRED EMBODIMENTS

Figure 1:
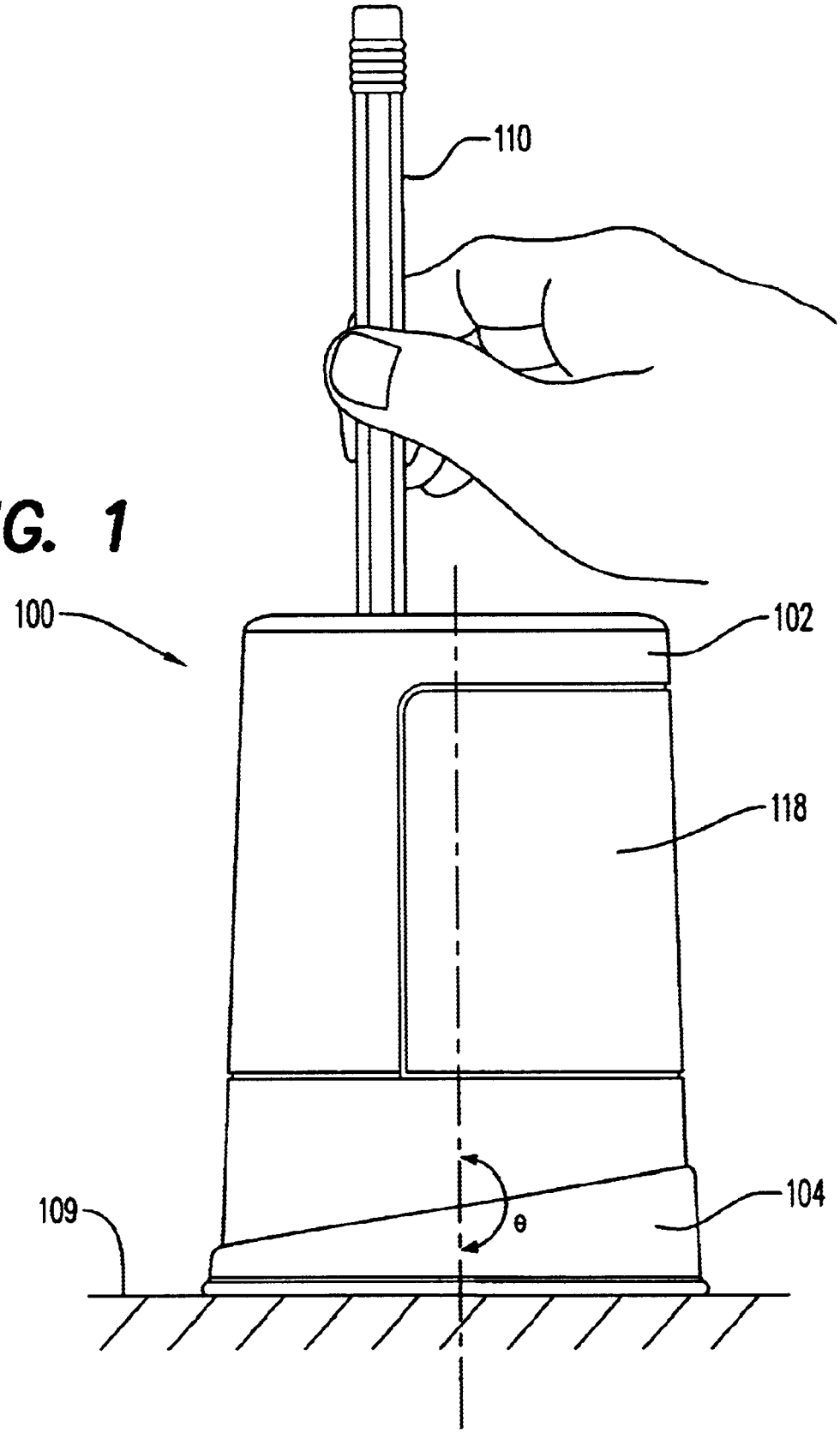
FIG. 1 is a side view of an electric pencil sharpener according to a first embodiment of the present invention, in a first configuration.
Figure 2B:
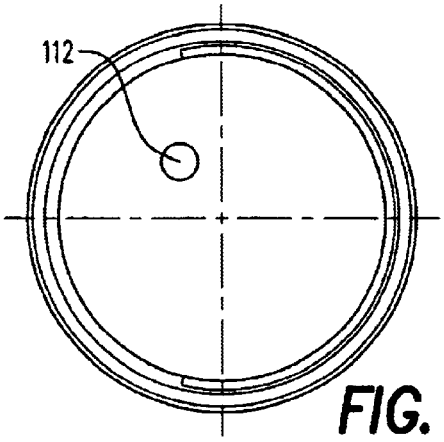
FIG. 2B is a top view of the electric pencil sharpener shown in FIG. 2A.
Figure 2A:
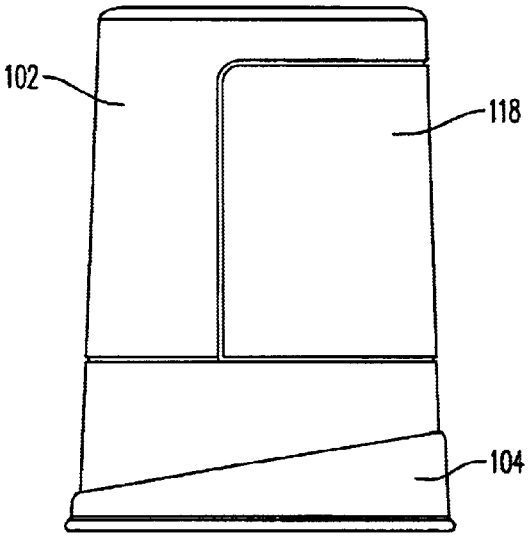
FIG. 2A is a side view of the electric pencil sharpener shown in FIG. 1, with the pencil removed.
Figure 2D:
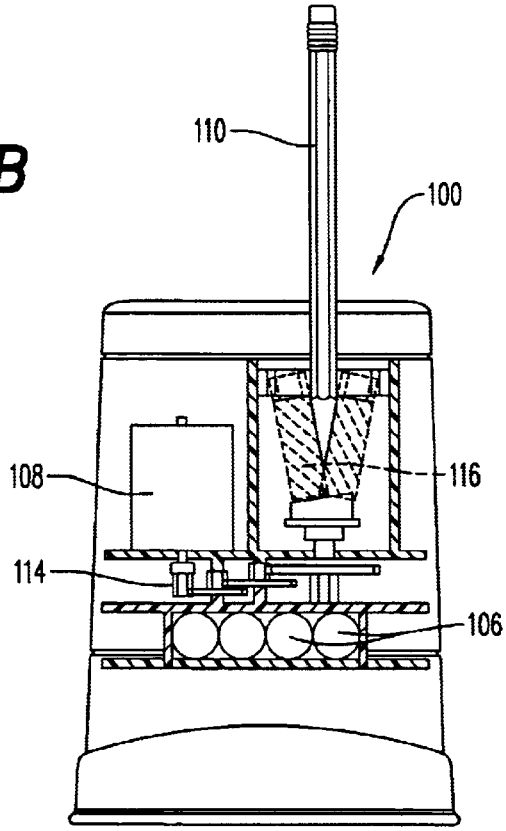
FIG. 2D is a front view of the electric pencil sharpener shown in FIG. 2A, showing part of its internal structure.
Figure 2C:
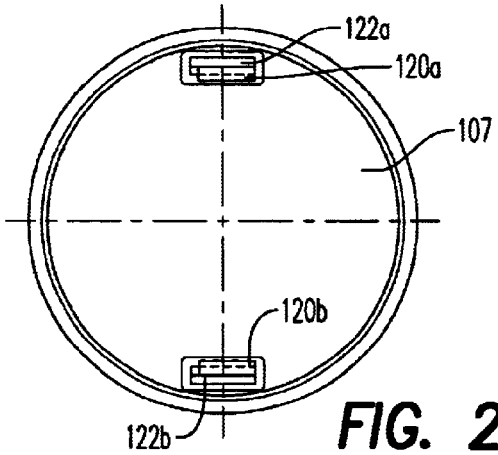
FIG. 2C is a bottom view of the electric pencil sharpener shown in FIG. 2A.
Figure 3:
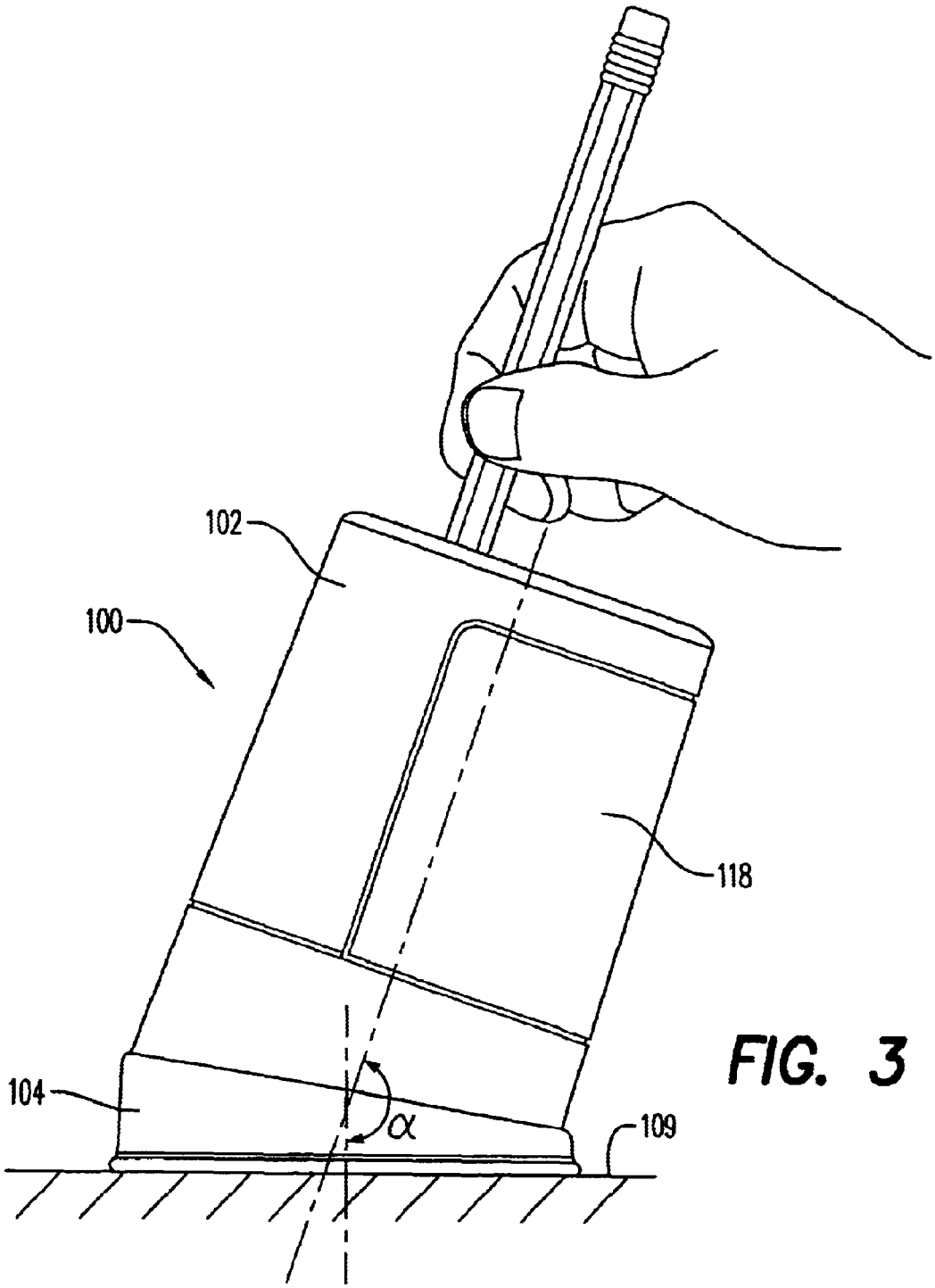
FIG. 3 is a side view of the electric pencil sharpener shown in FIG. 1 in a second configuration.

An electric pencil sharpener according to a first embodiment of the present invention is shown in FIGS. 1 to 3, and generally designated as 100.

The pencil sharpener 100 includes a body 102 and a base 104. As shown in FIG. 2D, housed within the body 102 are a number of batteries 106 electrically connected to a motor 108. In the conventional manner, when a pencil 110 is inserted through a hole 112 sufficiently downwardly, the pencil sharpener 100 will be activated, whereupon the motor 108 will move, via gear chains 114, a helical cutter 116 to cut the pencil 110. A receptacle 118 is releasably engaged with the body 102 for receiving debris cut out from the pencil 110. The receptacle 118 may be detached from the body 102 for disposing of the debris collected therein. The base 104 includes a bottom 107 for supporting the pencil sharpener 100 on a surface 109, e.g. a desk.

At the lower end of the body 102 are two resilient hooks 120*a*, 120*b*, each received within and engaged with a respective hole 122*a*, 122*b* at the bottom 107 of the base 104. When the body 102 and the base 104 are engaged with each other in this position, i.e. with the hook 120*a* received within and engaged with the hole 122*a*, and the hook 120*b* received within and engaged with the hole 122*b*, the whole pencil sharpener 100 will be in the configuration as shown in FIGS. 1 and 2A. In this configuration, the longitudinal axis of the body 102 is generally parallel to an axis which is perpendicular to the bottom 107 of the base 104. As shown in FIG. 1, the angle θ subtended between the two axes is substantially 180°. In this configuration, the pencil 110 has to be positioned vertically in order to be received within the hole 112 for sharpening. This may not be very comfortable to a user.

The pencil sharpener 100 may be caused to assume the configuration shown in FIG. 3. In order to move to this configuration, the hooks 120*a*, 120*b* of the body 102 are disengaged from the respective holes 122*a*, 122*b*, the body 102 is rotated by 180°, and the hook 120*a* is received within and engaged with the hole 122*b*, whereas the hook 120*b* is received within and engaged with the hole 122*a*. In this configuration, and as shown in FIG. 3, the angle a between the longitudinal axis of the body 102 and the axis perpendicular to the bottom 107 of the base 104 is an obtuse angle of less than 180°. To insert the pencil 110 into the body 102, the pencil 110 can be held in the inclined manner as shown in FIG. 3, which is found to be more convenient to most users.

Figure 4A:
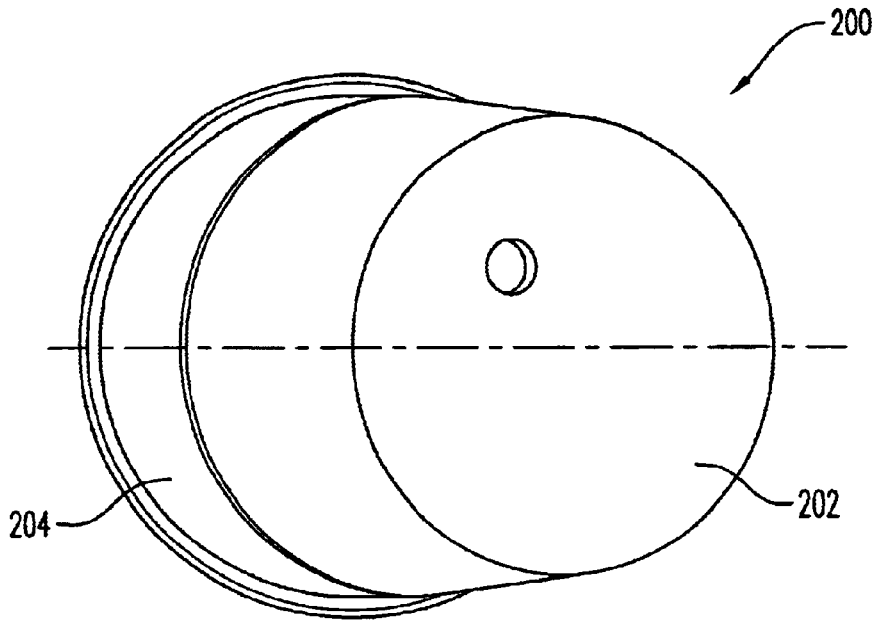
FIG. 4A is a top view of an electric pencil sharpener according to a second embodiment of the present invention, in a first configuration.
Figure 4B:
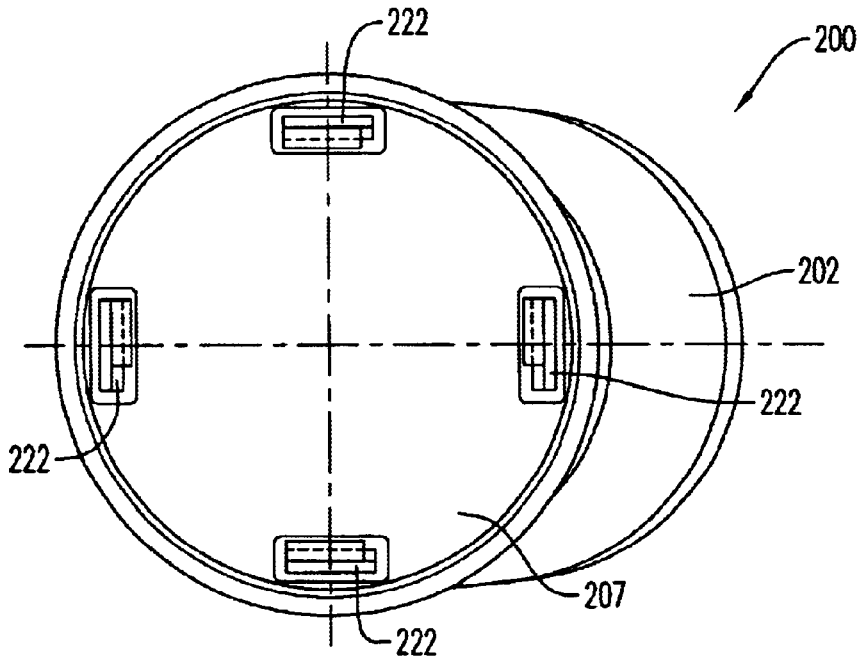
FIG. 4B is a bottom view of the electric pencil sharpener shown in FIG. 4A.
Figure 4C:
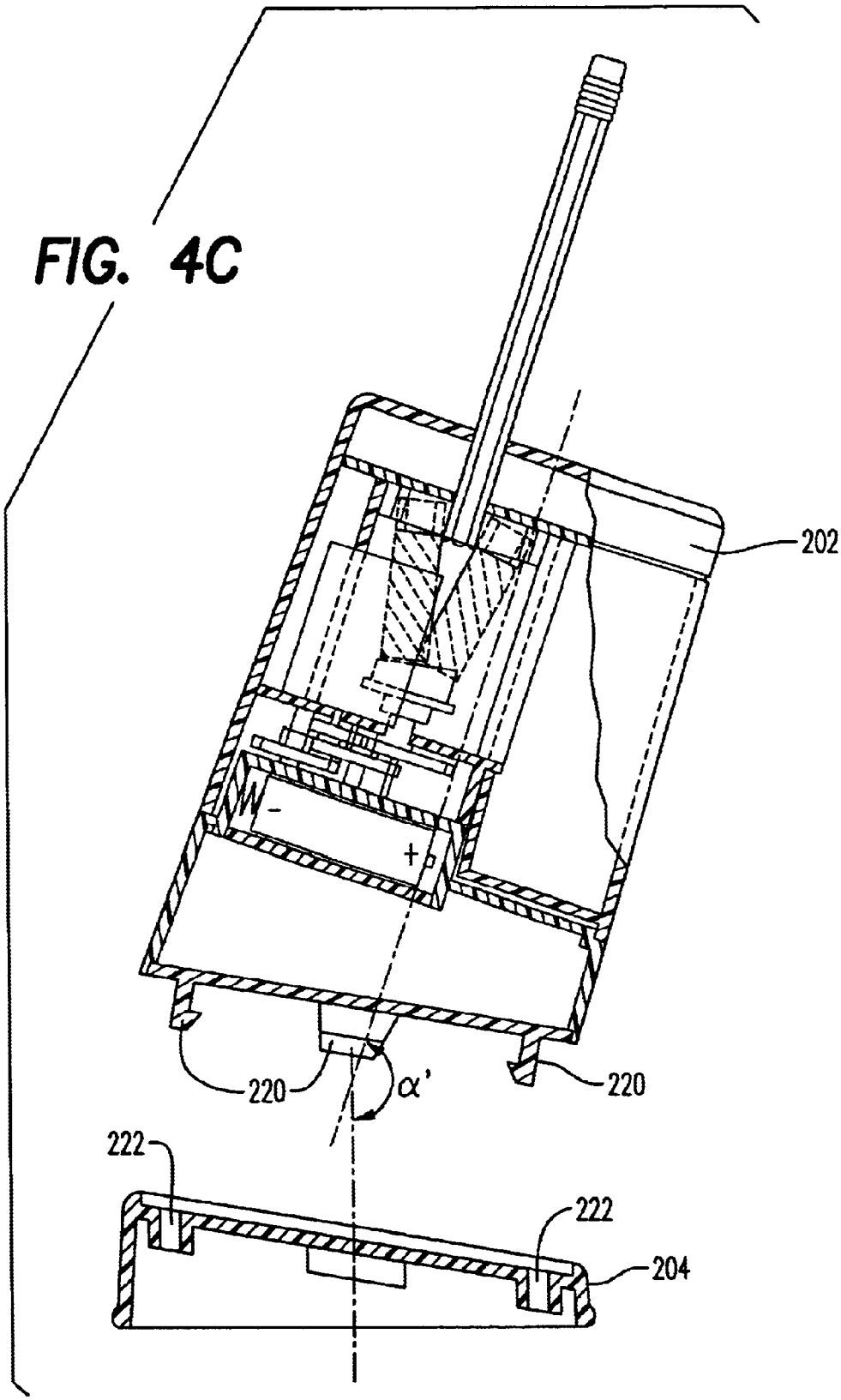
FIG. 4C is an exploded part-sectional side view of the electric pencil sharpener shown in FIG. 4A.

An electric pencil sharpener according to a second embodiment of the present invention is shown in FIGS. 4A to 4E, and generally designated as 200. The pencil sharpener 200 allows for more degree of freedom, as will be apparent from the following discussion. The pencil sharpener 200 is of a structure very similar to the sharpener 100 discussed above, except that at the lower end of a body 202 are four resilient hooks 220 each received within and engaged with a respective hole 222 at a bottom 207 of a base 204. When the body 202 and the base 204 are engaged in the configuration as shown in FIGS. 4A to 4C, an angle $\alpha'$ between a longitudinal axis of the body 202 and an axis perpendicular to a bottom 207 of the base 204 is an obtuse angle, i.e. between 90° and 180°.

Figure 4D:
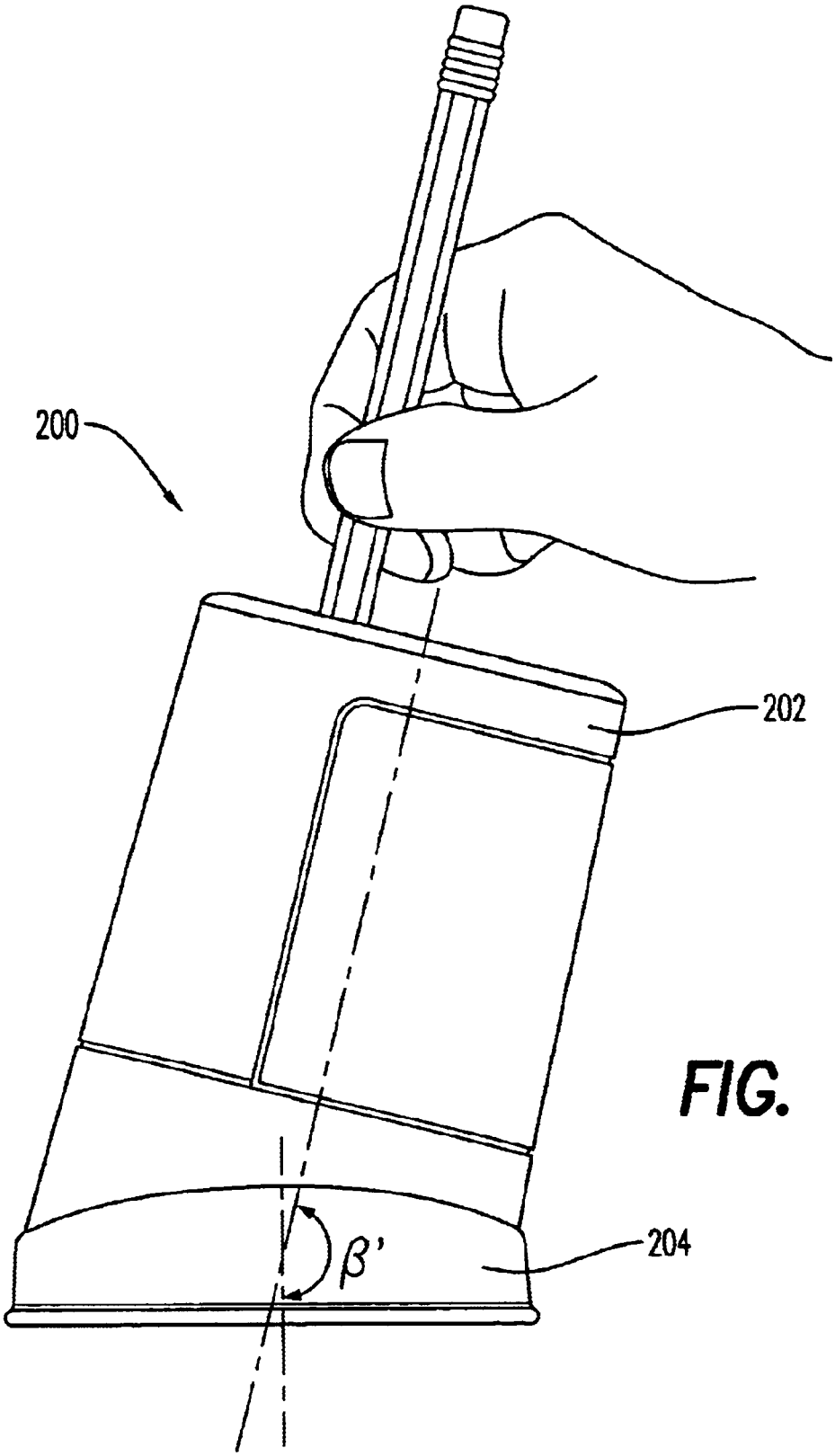
FIG. 4D is a side view of the electric pencil sharpener shown in FIG. 4A in a second configuration.

As in the case of the pencil sharpener 100 discussed above, the resilient hooks 220 may be disengaged from the holes 222. The body 202 may then be rotated relative to the base 204 by 90°, whereupon the hooks 220 and holes 222 are again aligned for engagement. When the body 202 and the base 204 are thus engaged, the pencil sharpener 200 will assume the configuration as shown in FIG. 4D. In this configuration, the longitudinal axis of the body 202 and the axis perpendicular to the bottom 207 of the base 204 subtend an obtuse angle $\beta'$ which is larger than $\alpha'$.

Figure 4E:
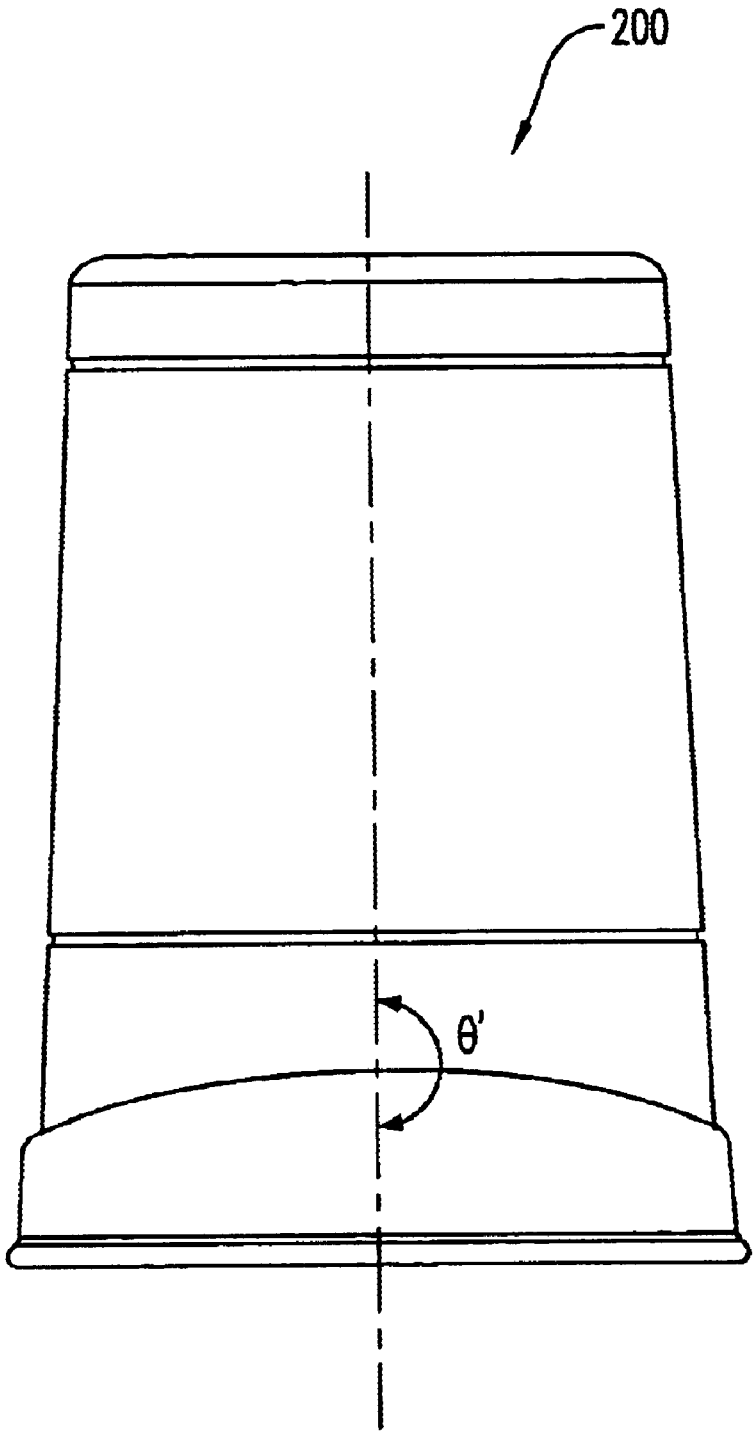
FIG. 4E is a side view of the electric pencil sharpener shown in FIG. 4A in a third configuration.

The body 202 may again be disengaged from the base 204, rotated another 90°, and subsequently engaged again with the base 204, so that the pencil sharpener 200 will assume the configuration shown in FIG. 4E. In this position, the longitudinal axis of the body 202 is parallel to the axis perpendicular to the bottom 207 of the base 204, so that an angle $\theta'$ therebetween is 180°.

By way of such an arrangement, three different degrees of inclination between the longitudinal axis of the body 202 and a support surface on which the pencil sharpener 200 rests are provided. Although four hooks 220 are here described, two diametrically opposed hooks 220 will suffice for releasably securing the body 202 with the base 204.

Figure 5A:
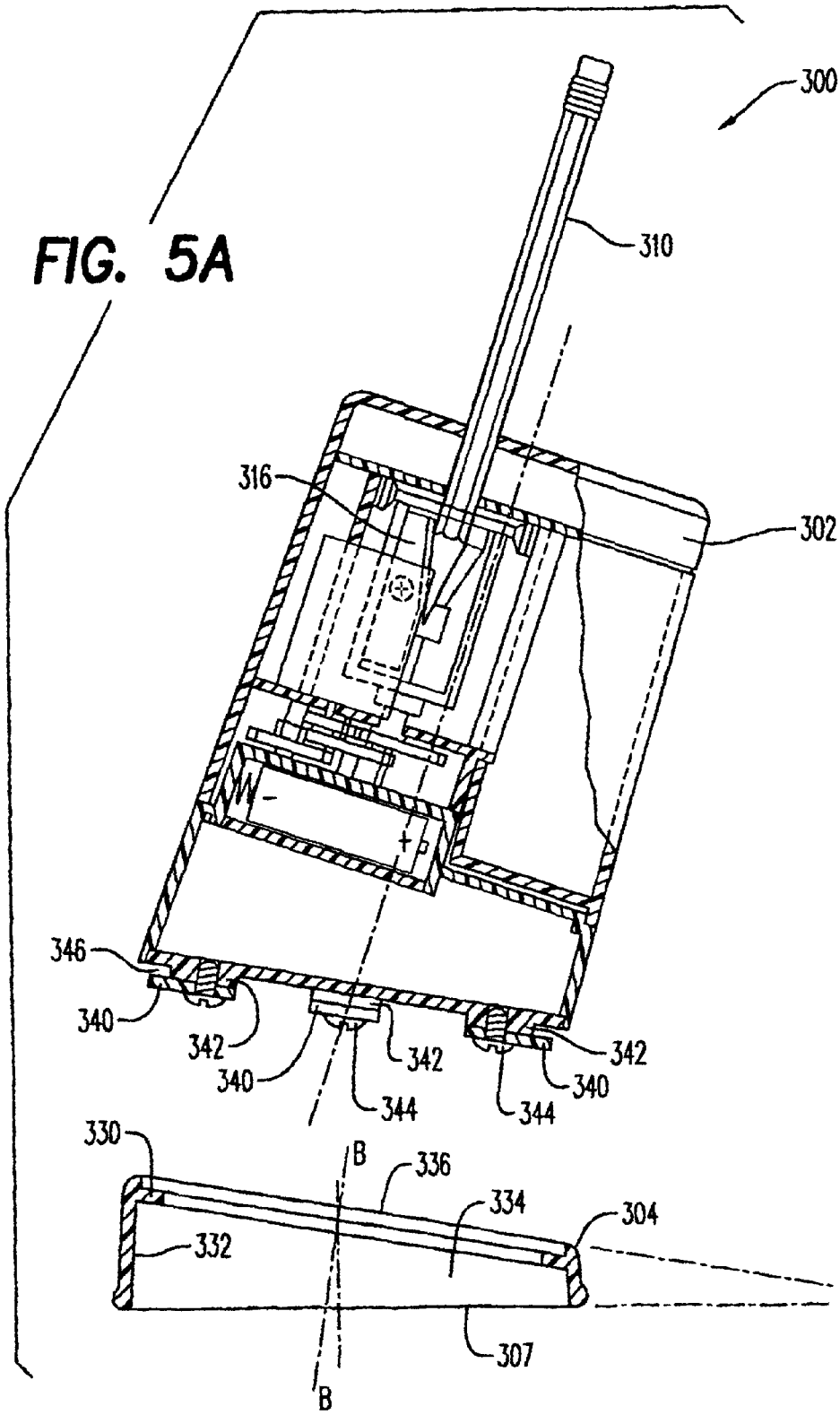
FIG. 5A is an exploded part-sectional side view of an electric pencil sharpener according to a third embodiment of the present invention, in a first configuration.
Figure 5B:
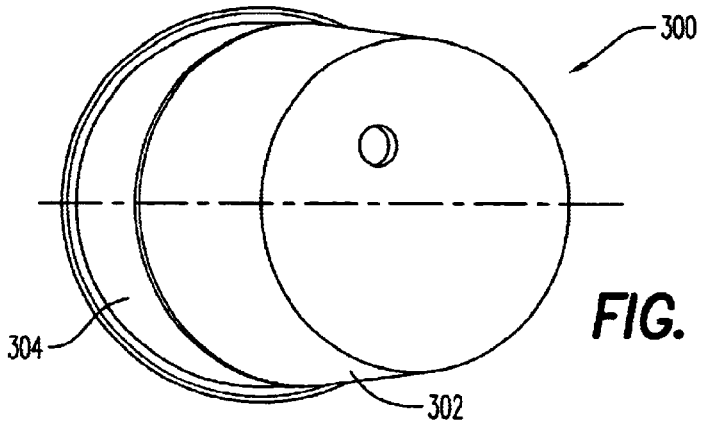
FIG. 5B is a top view of the electric pencil sharpener shown in FIG. 5A.

To be even more versatile, an electric pencil sharpener according to a third embodiment of the present invention is provided and generally designated as 300 in FIGS. 5A to 5L. As in the case of the pencil sharpeners 100 and 200 discussed above, the pencil sharpener 300 also includes a body 302 and a base 304. Within the body 302, a motor 308 is housed for moving a razor cutter 316 to cut a pencil 310 inserted into the body 302. As can be seen in FIG. 5A, the base 304 is generally hollow with an upper end 336 which is inclined relative to a bottom 307 at an acute angle $\phi$. Near the top of the base 304 is an annular extension 330 which extends inwardly from an inner surface 332 into a cavity 334 of the base 304. The annual extension 330 is parallel to the upper end 336, and is thus also inclined relative to a bottom 307 at the angle $\phi$.

At the lower end of the body 302 are four radially outwardly extending fingers 340. Each of these fingers 340 is secured via a screw 344 to a respective leg 342 extending downwardly from the bottom of the body 302. As the fingers 340 are wider than the legs 342, a recess 346 is formed. The annual extension 330 may then be received within the recesses 346 formed by the legs 342 and the fingers 340. By way of such an arrangement, the body 302 may be rotated relative to the base 304 about an axis B—B (see FIG. 5A) which is perpendicular to the annular extension 330, which is in turn parallel to the upper end 336 of the base 304. Although four fingers 340 are shown in this example, it should be understood that two diametrically opposed fingers 340 would suffice for the purpose.

Figure 5C:
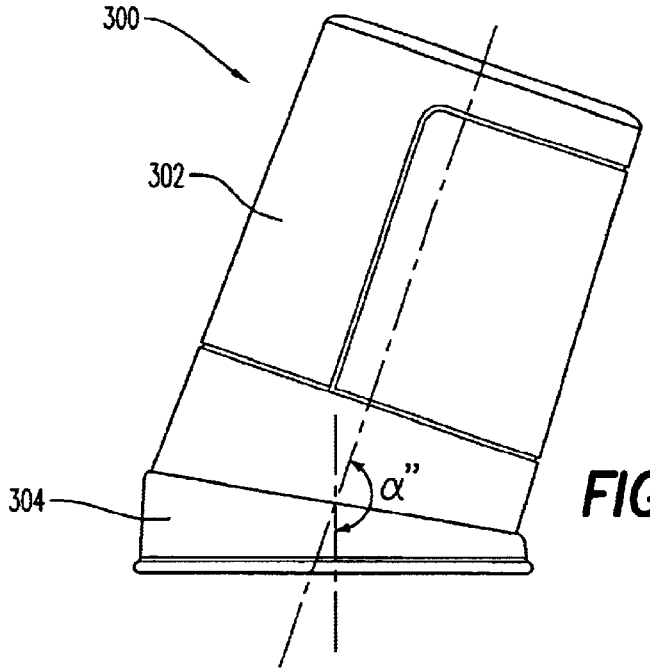
FIG. 5C is a side view of the electric pencil sharpener shown in FIG. 5A.
Figure 5D:
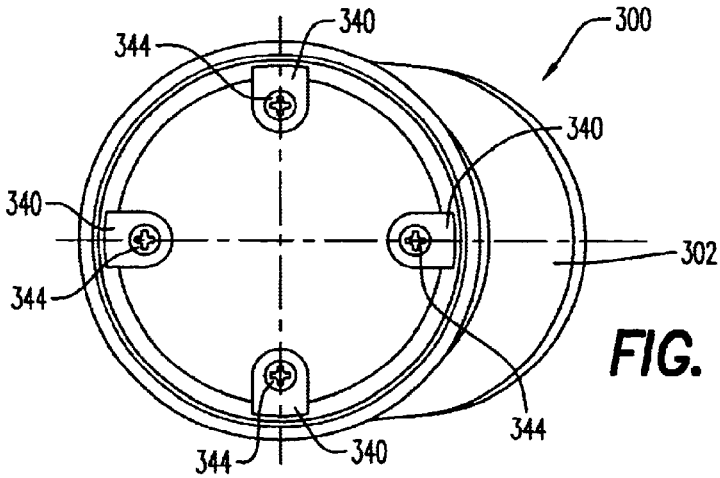
FIG. 5D is a bottom view of the electric pencil sharpener shown in FIG. 5A.
Figure 5E:
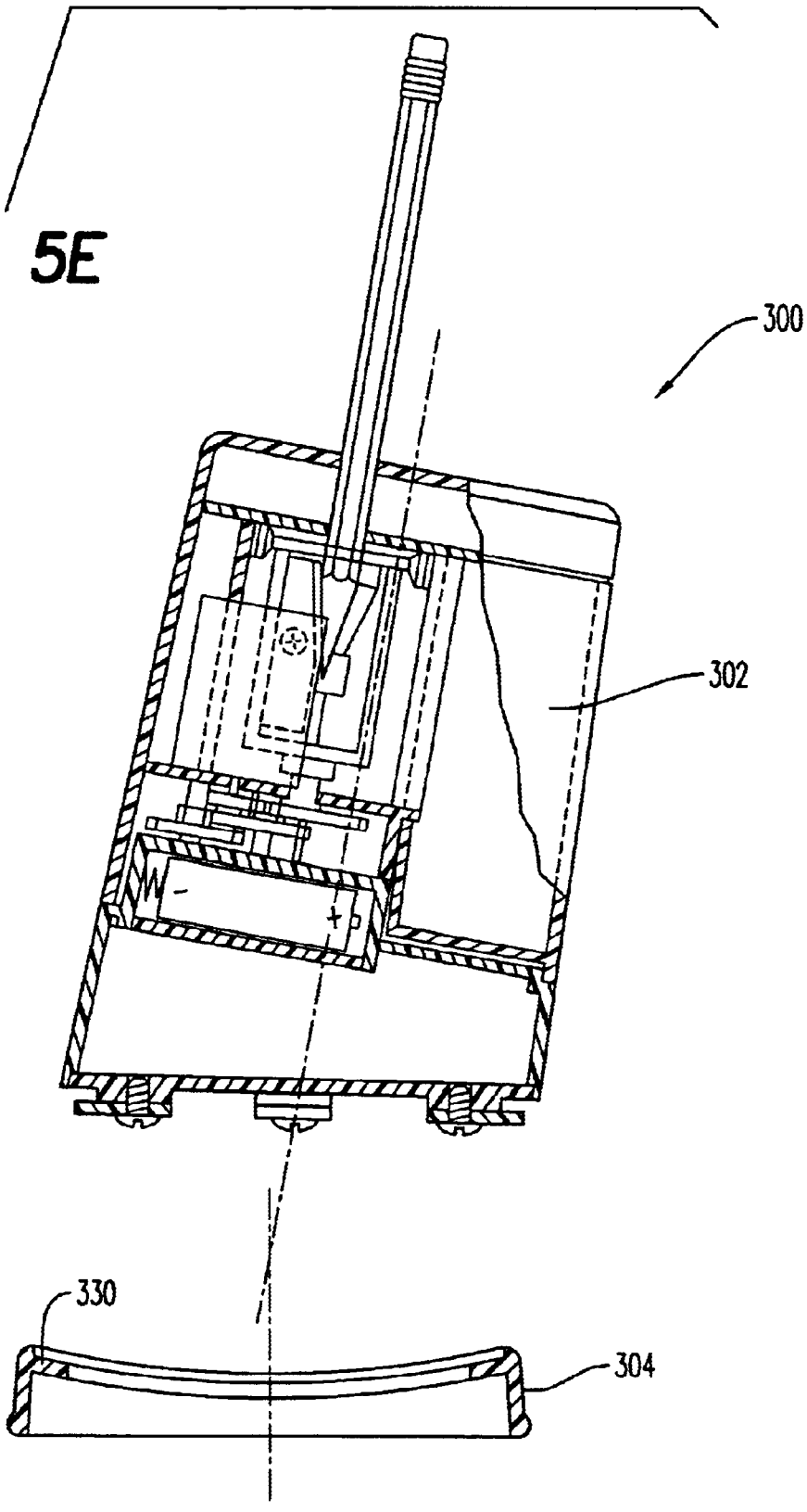
FIG. 5E is an exploded part-sectional side view of the electric pencil sharpener shown in FIG. 5A, in a second configuration.
Figure 5F:
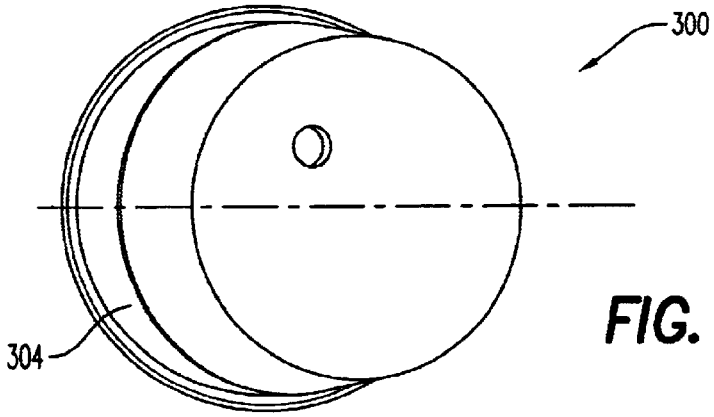
FIG. 5F is a side view of the electric pencil sharpener shown in FIG. 5E.
Figure 5G:
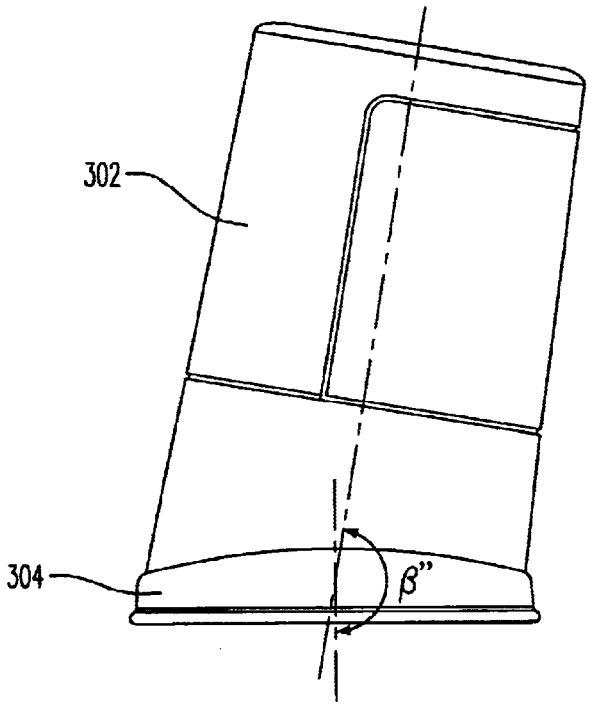
FIG. 5G is a side view of the electric pencil sharpener shown in FIG. 5E.
Figure 5H:
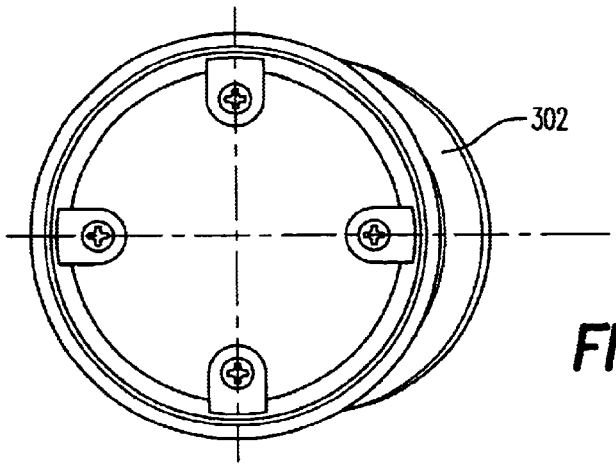
FIG. 5H is a bottom view of the electric pencil sharpener shown in FIG. 5E.
Figure 5I:
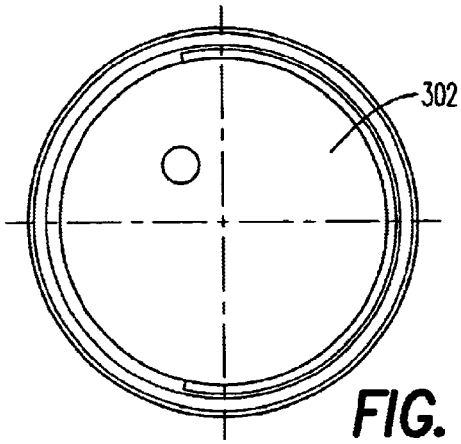
FIG. 5I is a top view of the electric pencil sharpener shown in FIG. 5A, in a third configuration.
Figure 5J:
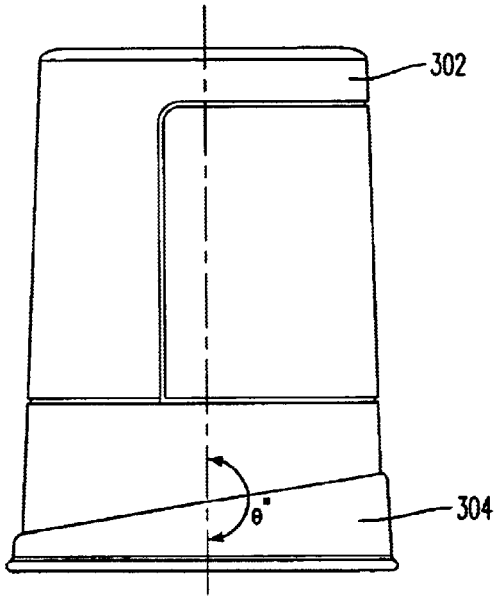
FIG. 5J is a side view of the electric pencil sharpener shown in FIG. 5I.
Figure 5K:
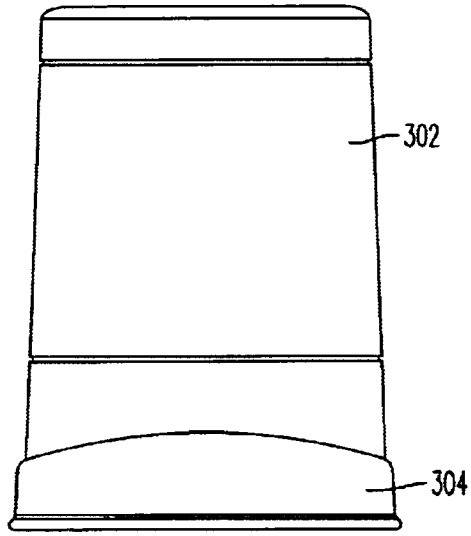
FIG. 5K is a front view of the electric pencil sharpener shown in FIG. 5I.
Figure 5L:
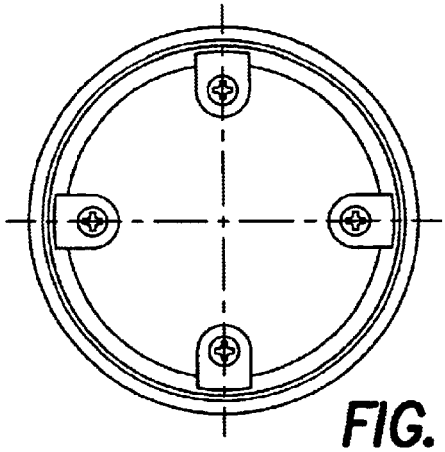
FIG. 5L is a bottom view of the electric pencil sharpener shown in FIG. 5I.

As shown in FIGS. 5A to 5D, the body 302 is inclined to the bottom 307 of the base 304 by an obtuse angle $\alpha''$ (see FIG. 5C). The pencil sharpener 300 may be rotated to assume the configuration shown in FIGS. 5E to 5H, in which the body 302 is inclined to the bottom 307 of the base 304 by an obtuse angle $\beta''$ (see FIG. 5G) which is larger than the angle $\alpha''$. The pencil sharpener 300 may be further rotated to assume the configuration shown in FIGS. 5I to 5L, in which the body 302 is inclined to the bottom 307 of the base 304 by an obtuse angle $\theta''$ (see FIG. 5J), which is 180°. It can be seen that, with the pencil sharpener 300, the user may adjust the angle between the longitudinal axis of the body 302 and the axis perpendicular to the bottom 307 of the base 304 to be anywhere between $\alpha''$ and $\theta''$, i.e. 180°, thus allowing a much higher degree of freedom in use, to suit the specific need of the particular user.

It should be understood that the above only illustrates examples whereby the present invention may be carried out, and that various modifications and/or alterations may be made thereto without departing from the spirit of the invention.

It should also be understood that certain features of the invention, which are, for clarity, described in the context of separate embodiments, may be provided in combination in a single embodiment. Conversely, various features of the invention which are, for brevity, described in the context of a single embodiment, may also be provided separately or in any appropriate sub-combinations.

What is claimed is:

1. An apparatus for sharpening a writing instrument, including a sharpening means having a cutting surface for sharpening said writing instrument, a body member and base member, said body member being adapted to receive said writing instrument for sharpening, said base member having a bottom surface adapted to support said apparatus on a surface, wherein said body member is positionable relative to said base member in a first configuration and at least a second configuration, wherein when said body member is positioned relative to said base member in said first configuration, a longitudinal axis of said body member and an axis substantially perpendicular to said bottom surface of said base member subtend a first angle, and when said body member is positioned relative to said base member in said second configuration, said longitudinal axis of said body member and said axis substantially perpendicular to said bottom surface of said base member subtend a second angle which differs from said first angle.

2. An apparatus according to claim 1 wherein said body member is positionable relative to said base member in more than two configurations.

3. An apparatus according to claim 1 wherein said apparatus is electrically operable.

4. An apparatus according to claim 1 wherein when said body member is positioned relative to said base member in said first configuration, said longitudinal axis of said body member is substantially parallel to said axis substantially perpendicular to said bottom surface of said base member.

5. An apparatus according to claim 1 wherein said body member and said base member are releasably engageable with each other.

6. An apparatus according to claim 5 wherein said body member includes at least a hook member receivable within a respective hole of said base member for releasably engaging said body member with said base member.

7. An apparatus according to claim 1 wherein said body member is rotatable about said base member.

8. An apparatus according to claim 7 wherein said body member is rotatable about said base member about an axis substantially perpendicular to an upper end of said base member.

9. An apparatus according to claim 7 wherein said base member includes a track member along which at least part of said body member is movable.

10. An apparatus according to claim 9 wherein said track member is substantially annular in shape.

11. An apparatus for sharpening a writing instrument, comprising: a sharpening means having a cutting surface for sharpening said writing instrument, a base member having a bottom face adapted to support said apparatus on a surface and an upper face which defines a plane disposed at an obtuse angle relative to a pivot axis perpendicular to said bottom face; and a body member adapted to receive a writing instrument for sharpening, said body member having a bottom face that engages said upper face of said base member to allow rotational movement of said body member relative to said base member around said pivot axis, said bottom face of said body member defining a plane that is at an obtuse angle relative a longitudinal axis of said body member such that, at one rotational position, said longitudinal axis is coincident with said pivot axis and, at another rotational position, said longitudinal axis forms as obtuse angle with said pivot axis.

12. An apparatus according to claim 11 wherein said body member and said base member are releasably engageable with each other.

13. An apparatus according to claim 12 wherein said body member includes at least a hook member receivable within a respective hole of said base member for releasably engaging said body member with said base member.

14. An apparatus according to claim 11 wherein said base member includes a track member along which at least part of said body member is movable.

15. An apparatus according to claim 14 wherein said track member is substantially annular in shape.

* * * * *